US006309261B1

(12) United States Patent
Chadbourne

(10) Patent No.: US 6,309,261 B1
(45) Date of Patent: Oct. 30, 2001

(54) LAMINATED WEDGE CONNECTOR

(75) Inventor: Richard Chadbourne, Merrimack, NH (US)

(73) Assignee: FCI USA, Inc., Fairfield, CT (US)

( * ) Notice: Subject to any disclaimer, the term of this patent is extended or adjusted under 35 U.S.C. 154(b) by 0 days.

(21) Appl. No.: 09/596,508

(22) Filed: Jun. 19, 2000

(51) Int. Cl.[7] ..... H01R 4/50; H01R 11/01
(52) U.S. Cl. ..... 439/783
(58) Field of Search ..... 439/783, 770, 439/772, 807, 863

(56) References Cited

U.S. PATENT DOCUMENTS

| | | | |
|---|---|---|---|
| 3,462,543 | 8/1969 | Wahl et al. | 174/94 |
| 3,516,050 | 6/1970 | Mixon, Jr. et al. | 339/247 |
| 3,588,791 | 6/1971 | Polidori | 339/247 |
| 4,279,461 | 7/1981 | Bussen et al. | 339/246 |
| 4,600,264 | 7/1986 | Counsel | 339/247 |
| 5,538,447 | 7/1996 | Chadbourne et al. | 439/783 |
| 5,820,422 | 10/1998 | Chadbourne et al. | 439/783 |
| 5,911,604 * | 6/1999 | Chadbourne | 439/783 |
| 6,093,064 * | 7/2000 | Callen et al. | 439/783 |

OTHER PUBLICATIONS

L.V./M.V. FCI Framatome Group Catalog, Anchor Clamps for Bare or Insulated Messengers, pp 1.11.

* cited by examiner

*Primary Examiner*—Renee Luebke
*Assistant Examiner*—Felix O. Figueroa
(74) *Attorney, Agent, or Firm*—Perman & Green, LLP

(57) ABSTRACT

An electrical wedge connector comprising a shell, and a wedge section. The wedge section is sized and shaped to be inserted into the shell for connecting two conductors to each other. The wedge section is laminated.

22 Claims, 4 Drawing Sheets

FIG.2
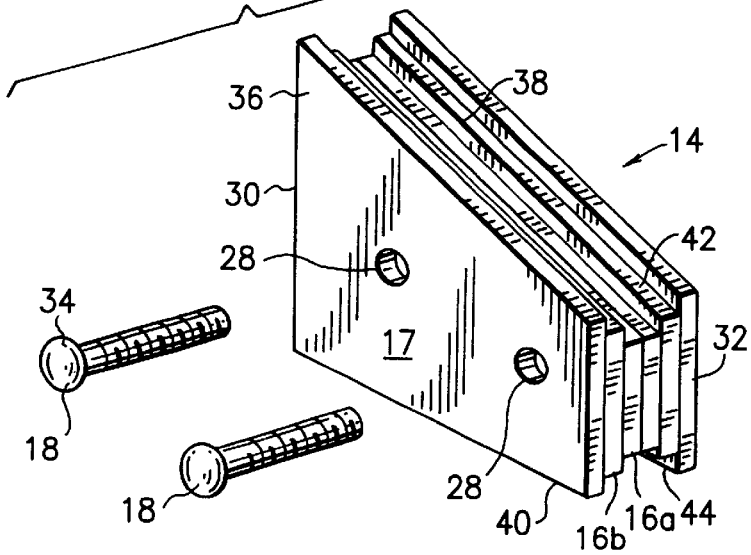
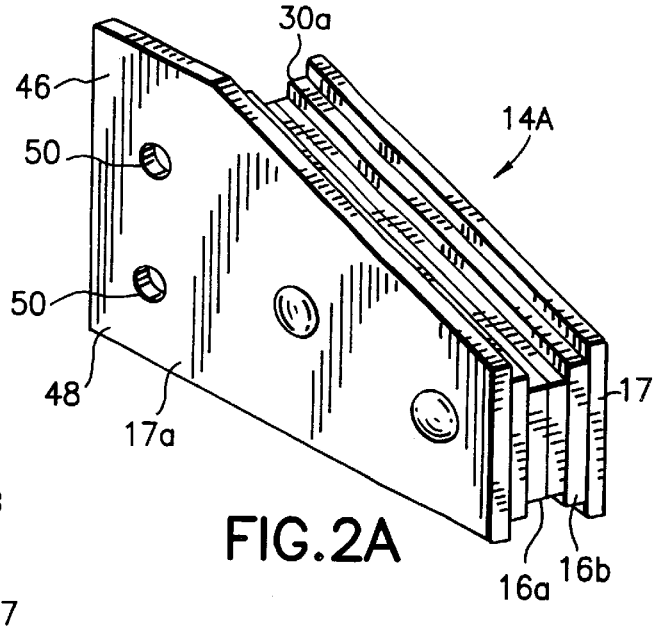
FIG.2A
FIG.2B
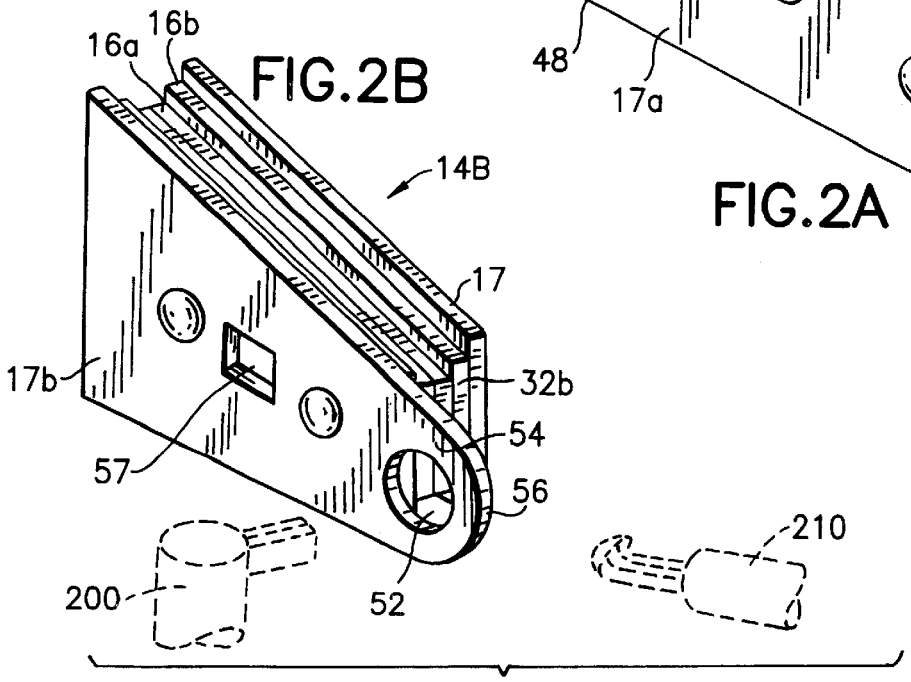

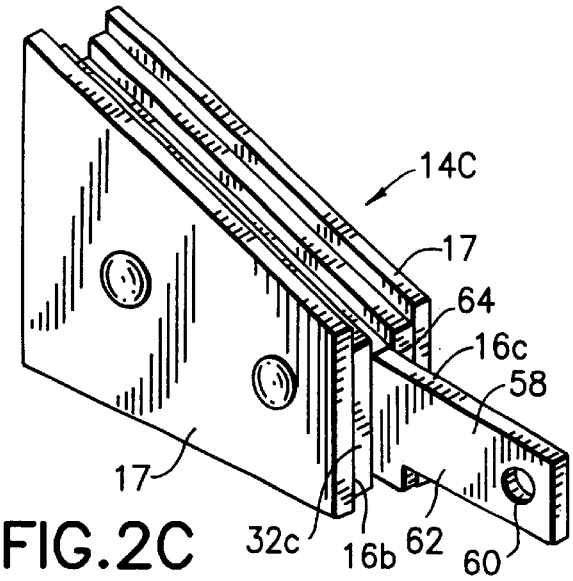
FIG.2C
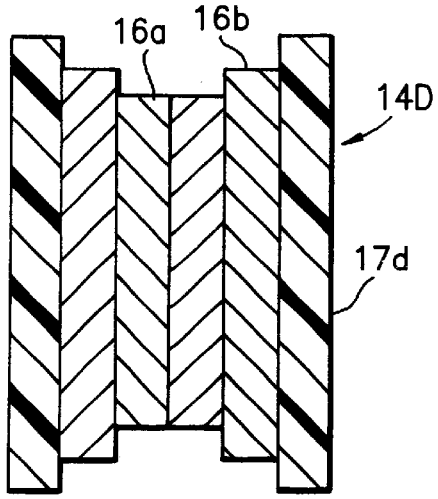
FIG.2D
FIG.2E
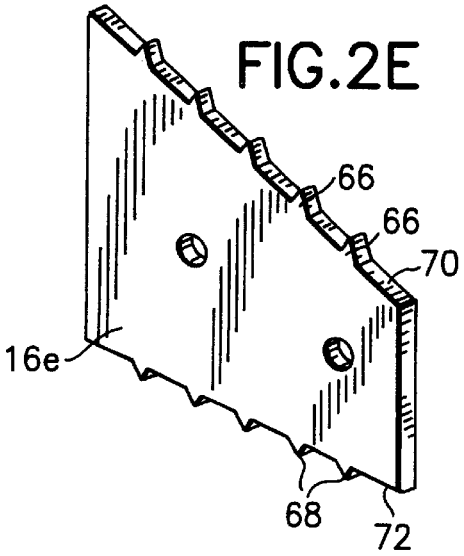

LAMINATED WEDGE CONNECTOR

BACKGROUND OF THE INVENTION

1. Field of the Invention

The present invention relates to electrical wedge connectors and, more particularly, to wedge connectors having a laminated wedge.

2. Prior Art

U.S. Pat. No. 3,462,543 discloses a connector assembly including a body member with inner inclined surfaces, and a wedge member which is inserted into the body member to engage a conductor with a round body member extending from the body member. U.S. Pat. No. 3,588,791 discloses a wedge type electrical connector with a C-shaped housing and a wedge member which is driven into the C-shaped housing. U.S. Pat. No. 3,516,050 discloses a connector assembly comprising a C-shaped body member, and a wedge member disposed therein, and various sticks for assembling the connector assembly when connecting a line onto a high voltage line. U.S. Pat. No. 4,279,461 discloses a wedge connector with a C-shaped spring member, and a wedge member which includes a plurality of threaded holes for receiving a bolt which extend perpendicularly through the spring member wall. U.S. Pat. No. 4,600,264 discloses a connector assembly with a cable receiving housing, and a complementing wedge block including a bolt for drawing the wedge block into the housing. U.S. Pat. No. 5,538,447 discloses an electrical connector comprising a sleeve, and a one piece wedge with a center section housing outwardly laterally biased sections.

SUMMARY OF THE INVENTION

In accordance with a first embodiment of the present invention, an electrical wedge connector is provided. The electrical wedge connector comprises a shell and a wedge section. The wedge section is sized and shaped to be inserted into the shell for connecting two conductors to each other. The wedge section is laminated.

In accordance with a second embodiment of the present invention, an electrical wedge connector is provided. The electrical wedge connector comprises a shell, and a wedge assembly. The wedge assembly is sized and shaped to be inserted into the shell for connecting two conductors to each other. The wedge assembly comprises plate members assembled in a stack. At least one of the plate members is an interchangeable plate member selected to provide the wedge assembly with a predetermined characteristic.

In accordance with a method of the present invention, a method for fabricating an electrical wedge connector is provided. The method comprises the steps of providing a shell, stamping plate members, assembling the plate members, and connecting the plate members. The shell is provided with a general wedge shape. The plate members are assembled into a stack forming a wedge assembly. The wedge assembly is sized and shaped to be inserted into the shell for connecting two conductors to each other. The plate members are connected in the stack by bonding or riveting.

BRIEF DESCRIPTION OF THE DRAWINGS

The foregoing aspects and other features of the present invention are explained in the following description, taken in connection with the accompanying drawings, wherein:

FIG. 2 is an exploded partial perspective view of a wedge assembly for the wedge connector in FIG. 1 in accordance with a first preferred embodiment of the present invention;

FIGS. 2A–2B are perspective views of the wedge assembly in FIG. 2 respectively showing different predetermined configurations of the wedge assembly;

FIG. 2C is another perspective view of the wedge assembly in FIG. 2 showing another predetermined configuration of the wedge assembly;

FIG. 2D is a cross-sectional view of the wedge assembly in FIG. 2, showing still another predetermined configuration of the wedge assembly;

FIG. 2E is a perspective view of an interchangeable plate member for use in the wedge assembly shown in FIG. 2;

DETAILED DESCRIPTION OF THE PREFERRED EMBODIMENT

Figure 1:
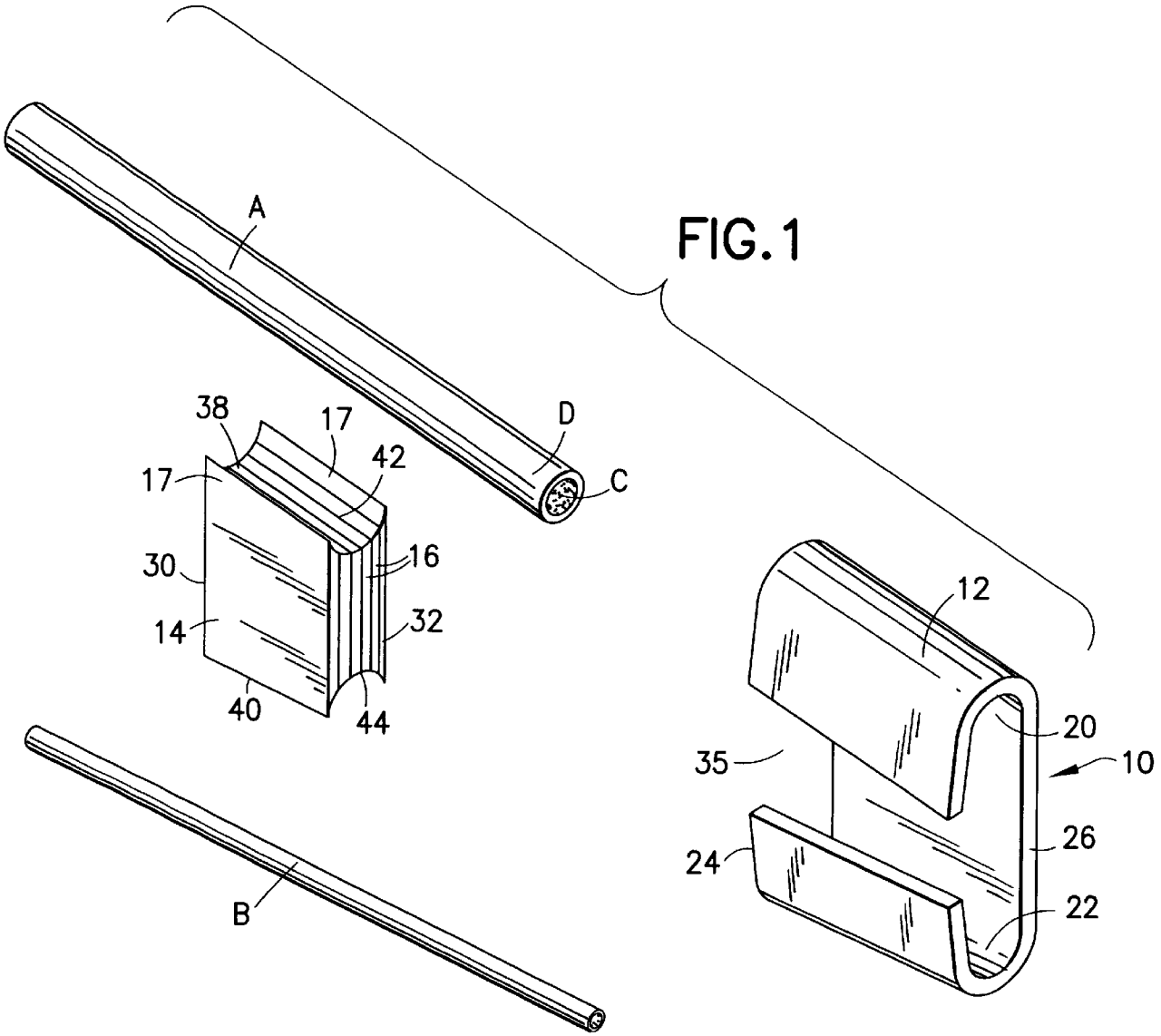
FIG. 1 is an exploded perspective view of an electrical wedge connector incorporating features of the present invention and two conductors.

Referring to FIG. 1, there is shown an exploded perspective view of an electrical wedge connector 10 incorporating features of the present invention and two conductors A, B. Although the present invention will be described with reference to the single embodiment shown in the drawings, it should be understood that the present invention can be embodied in many alternate forms of embodiments. In addition, any suitable size, shape or type of elements or materials could be used.

The conductors A, B, illustrated in FIG. 1 are insulated conductors which generally comprise an inner electrical conductive section C and an outer layer D of electrically insulating material. The present invention applies equally to cases where one or both of the conductors is a bare electrical conductor. The electrical wedge connector 10 generally comprises a shell 12 and wedge assembly 14. The wedge assembly 14 is inserted into the shell 12 between insulated conductors A, B. The conductors A, B are thus captured in shell 12 by wedge assembly 14 thereby connecting the conductors to each other. The wedge assembly 14 includes laminations or plate members 16, 17. The plate members 16, 17 making up the wedge assembly are interchangeable. The interchangeable plate members 16, 17 are selected to provide the wedge assembly 14 with a predetermined characteristic. As will be described in greater detail below, one or more of the plate members in the wedge assembly may have teeth or piercing protrusions thereon. When the wedge assembly is thus provided with teeth or piercing protrusions thereon, insertion of the wedge assembly against the conductors A, B in the shell 12 causes the piercing protrusions to pierce the insulating layer D of the conductors and effect an electrical connection between the wedge assembly and conductors. When used on bare conductors the teeth provide improved gripping of the conductor thus improving mechanical performance.

Referring still to FIG. 1, the shell 12 of the wedge connector 10 has a general "C" shape forming two conductor receiving channels 20, 22 at opposite top and bottom sides of the shell. The shell 12 is tapered from rear 24 to front 26 to form a general wedge shape profile. In alternate embodiments, the shell of the wedge connector may have any other suitable shape.

Referring now also to FIG. 2, in accordance with a first preferred embodiment of the present invention, the wedge assembly 14 comprises a number of interchangeable plate members 16*a*, 16*b*, 17 and a pair of fasteners 18. The interchangeable plate members 16*a*, 16*b*, 17 are stacked together. The plate members 16*a*, 16*b*, 17 extend vertically from the top 38 to the bottom 40 of the stack forming the wedge assembly 14. In this preferred embodiment, all the plate members 16*a*, 16*b*, 17 are aligned with a longitudinal axis of the wedge assembly 14 (see FIG. 1). The wedge assembly 14 preferably includes two outer plate members 17, and inner plate members 16a, 16*b* sandwiched together between the outer plate members. The wedge assembly 14 may have any suitable number of inner plates 16*a*, 16*b*(only four inner plates 16*a*, 16*b* are shown along with the two outer plates 17 in FIG. 2 for example purposes). Preferably, the inner plate members 16*a*, 16*b* and the outer plate members 17 are one piece members. The outer plate members 17 and inner plate members 16*a*, 16*b* of wedge assembly 14 have a generally tapered shape from the rear 30 to the front 32. In the embodiment shown in FIG. 2, the inner plate members 16*a*, 16*b* are generally of smaller height than the outer plate members 17 such that, when the plate members 16*a*, 16*b*, 17 are stacked together, the stacked assembly forms conductor receiving areas 42, 44 at opposite top and bottom sides 38, 40 of wedge assembly 14. In the preferred embodiment, the inner plate members 16*a*, 16*b* may also be provided in various heights. For example, as shown in FIG. 2, the inner most plate members 16*a*, may be shorter than plate members 16b located further outwards in the wedge assembly 14. The use of plate members 16*a*, 16*b* of consecutively decreasing, and increasing heights allows the conductor receiving areas 42, 44 to conform more closely to the circumference of the conductors A, B. In alternate embodiments, the inner plate members of the wedge assembly may be of substantial uniform height. In other alternate embodiments, the heights of the inner, and outer plate members may be varied as desired in order to form conductor receiving areas of any suitable shape, including for example, forming one or both conductor receiving areas with multiple recesses for receiving multiple side-by-side conductors. In the preferred embodiment, shown in FIG. 2, the top and bottom edges of the inner and outer plate members 16*a*, 16*b* are substantially flat in the transverse direction, though the top and bottom edges may be beveled transversely in order to better define the curvature of the conductor receiving areas of the wedge assembly. Each of the plate members 16*a*, 16*b*, 17 have holes 28 to allow through fastening of the plate members with fasteners 18. In the preferred embodiment, the plate members have two holes 28 which are longitudinally aligned. In alternate embodiments, the plate members may have any suitable number of fastener holes formed therethrough in any suitable pattern. In other alternate embodiments, one or more of the plate members may have a threaded hole formed therein for threading a fastener. The fasteners 18 of the wedge assembly 14 are preferably blind domed rivets, though any suitable type of mechanical fastener may be used such as flat head rivets machine screws, and bolts. The fasteners 18 may be made of any suitable material such as metal or plastic. In alternate embodiments, the inner and outer plate members may be bonded together by any other suitable means such as staking, pinning, heat bonding, and chemical bonding using suitable chemical bonding agents such as epoxy.

The interchangeable inner, and outer plate members 16*a*, 16*b*, 17 of wedge assembly 14 may be made from any suitable conducting, or insulating material as desired in order to provide the wedge assembly 14 with a predetermined characteristic. By way of example, in the preferred embodiment, inner most plate members of assembly 14 may be made of highly conductive copper alloy. The more outward inner plate members 16*b* of assembly 14 may be made from steel, and the outer plate members 17 may be made from light aluminum alloys. The inner plate members 16*a*, made of copper alloy are highly conductive and increase the overall conductivity of the wedge assembly 14. The steel plate members 16*b* have high strength and thus provide the wedge assembly with high compressive strength to resist compressive forces on the wedge assembly. The outermost plate members 17 help reduce the weight of the wedge assembly 14. The aforementioned material makeup of plate members 16*a*, 16*b*, 17 and distribution of plate members within the stack forming wedge assembly 14 is merely exemplary and any other distribution may be used. Different interchangeable plate members may be used in the wedge assembly in order to obtain the desired performance characteristic. In the case where a wedge assembly of higher strength is preferred, additional plate members made of steel may be substituted in place of the aluminum, or copper plate members 16*a*, 16*b*. For example, one or both of the interchangeable inner most plate members 16*a* made of copper alloy, may be replaced with corresponding interchangeable plate members (not shown) made of steel. Similarly, to increase conductivity of wedge assembly 14, additional plate members may be added in place of steel, or aluminum alloy plate members. Also, where a lower weight for wedge assembly 14 is desired, more aluminum alloy plate members may be used. Correspondingly, in alternate embodiments, all interchangeable plate members in the wedge assembly may be made from the same material. Otherwise, as will be described in greater detail below, one or two of the interchangeable plate members in the wedge assembly may be made from a different material or have a different shape than the other plate members in the wedge assembly.

The inner and outer plate members of wedge assembly 14 are preferably stamped out from plate stock of suitable thickness, though the individual plate members may be formed by any other suitable means from any other type of material. In the case where thin plate stock is used, a larger number of plate members may be used to make up the wedge assembly. The plate members are stamped in the various sizes corresponding to the different inner, and outer plate members 16*a*, 16*b*, 17 and from the desired materials as previously described. The mounting holes 28 may be punched or drilled through the plate members 16*a*, 16*b*, 17. The mounting holes 28 are located relative to the top and bottom edges of each plate member such that when the plate members 16*a*, 16*b*, 17 are fastened with fasteners 18 to form wedge assembly 14, the plate members are arranged relative to each other to form the desired top and bottom conductor receiving areas 42, 44. To form the wedge assembly 14, the desired inner and outer plate members 16*a*, 16*b*, 17 for providing the wedge assembly with a given characteristic, are selected from amongst the interchangeable plate members and are stacked together according to size. The fastener holes 28 in the plate members are aligned and the fasteners 18 are inserted through the stacked plate members securing the plate members together and forming the wedge assembly 14. In the case were the fasteners have heads 34 protruding from the side 36 of wedge assembly 14, the fasteners 18 are orientated prior to insertion such that heads 34 are located on the side 36 of wedge assembly 14 facing the opening 35 in the C-shaped shell 12 when the wedge assembly is installed in the shell (see FIGS. 1 and 2).

Referring now also to FIG. 2D, a cross section of the wedge assembly is shown. The wedge assembly 14D in FIG. 2D, has a different predetermined configuration than the configuration of wedge assembly 14 in FIGS. 1 and 2. In the configuration shown in FIG. 2D, wedge assembly 14D is substantially the same as wedge assembly 14 illustrated in FIGS. 1 and 2, and described above, except as otherwise noted. Accordingly, similar features of the wedge assembly have similar reference numbers. Wedge assembly 14D includes plate members made from a suitable dielectric material such as glass filled plastic. In the preferred embodiment, the outer plate members 17*d* of wedge assembly 14D are made from the dielectric material. The inner plate members 16*a*, 16*b* which are sandwiched between the outer dielectric plate members 17*d* may be made from conducting materials as previously described. In alternate embodiment, some or all of the inner plate members may be also made from dielectric materials as desired in order to provide the wedge assembly with predetermined insulating characteristics. In the configuration shown in FIG. 2D, the fasteners (similar to fasteners 18 in FIG. 2) used for fastening the plate members may also be made from plastic such that all outer surfaces of wedge assembly 14D are insulating. Alternatively, as described previously, the dielectric plate members 17*d* may be chemically bonded to the inner plate members 16*a*, 16*b*. The dielectric plate members 17*d* may be cut from dielectric material stock of suitable thickness or otherwise formed to have the appropriate size and shape in any other suitable manner.

FIG. 2A depicts another predetermined configuration of wedge assembly 14A. The wedge assembly 14A in this configuration is provided with a terminal connection 46 for attaching a conductor terminal (not shown) thereto. In the preferred embodiment, the wedge assembly 14 in FIG. 2 may be configured into wedge assembly 14A in FIG. 2A by using interchangeable outer plate member 17*a* in place one of the outer plate members 17 of wedge assembly 14. Outer plate member 17*a* is substantially similar to outer plate member 17 (see FIG. 2) except as otherwise noted. Similar to plate members 17, plate member 17*a* is preferably a one piece member with a generally tapered shape. Plate member 17*a* may be made from a conducting material such as steel, aluminum alloy, or copper alloy. Plate member 17*a* has an extended rear section 48. The rear section 48 has two holes 50 formed therethrough. When the plate member 17*a* is stacked together with the other interchangeable plate members 16*a*, 16*b*, 17 to form the wedge assembly 14A, the outer plate member 17*a* is located to face the opening 35 in the shell section 12 (see FIG. 1). In wedge assembly 14A, the extended rear section 48 projects from the rear 30*a* of the wedge assembly and forms the terminal connection 46. Connector lugs on a conductor (not shown) may be fastened to one or both of the holes 50 in the terminal connection 46. In alternate embodiments, the outer plate member may be provided with an extended front section such that the connection terminal on the wedge assembly is projecting from the front end of the wedge. In other alternate embodiments, the outer plate member may have a terminal connection, or attachment member extending from the side of the plate member through the opening and the C-shaped shell section.

FIG. 2B depicts yet another predetermined configuration of wedge assembly 14B in which the wedge assembly includes an eye hole or porthole 52 used for hot sticking the wedge connector and/or attaching a cable supporting clamp for providing strain relief to one of the conductors. In the preferred embodiment, the wedge assembly is configured into the configuration shown in FIG. 2B, by using interchangeable outer plate member 17*b* in place of one of the other interchangeable outer plate members 17 (see also FIG. 2). Plate member 17*b* is substantially similar to other interchangeable outer plate members 17, 17*a* accept as noted. Outer plate member 17*b* is preferably a one piece member made from a suitable metal or plastic material. Plate member 17*b*, preferably, has an extended front section 54 compared to the other inner, and outer plate members 16*a*, 16*b*, 17 of wedge assembly 14B. In alternate embodiments, the outer plate member may have an extended rear section. Porthole 52 is formed in the front section 54 by drilling, punching, or any other suitable hole forming means. The front end 56 of the front section is rounded, though the front end may have any suitable shape. When the wedge assembly 14B is assembled, the outer plate member 17*b* with porthole 52, is located on the side facing the opening 35 in the shell section 12 (see FIG. 1). The front section 54 projects from the front 32*b* of the wedge assembly 14B. The porthole 52 in the front section 54 is sized to admit a complementing portion of a hot stick 200. The hot stick 200 may be used by a user in the field to engage the porthole 52 of wedge assembly 14B and remotely insert or withdraw the wedge assembly 14B from the shell section 12 with the hot stick when the connector 10 is being assembly on an elevated conductor, such as for example, a pole mounted high voltage wire. Otherwise, a complementing portion (such as a hook) of a cable supporting clamp 210 maybe engaged through the porthole 52 of wedge assembly 14B to secure the clamp 210 to the wedge assembly and thus provide strain relief to a conductor to which the clamp 210 is connected. The outer plate member 17*b* may have an aperture 57 or a step formed therein which provides an engagement surface which may engage the shell section for retaining the wedge assembly 14B in the shell section of the connector.

FIG. 2C illustrates still another configuration of the wedge assembly 14C, in which the wedge assembly includes a terminal connection 58 at the front end 32*c* of the wedge assembly. In the preferred embodiment, the terminal connection 58 is formed on one of the interchangeable inner plate member 16*c*. Inner plate member 16*c* is substantially similar to other interchangeable inner plate members 16*a*, 16*b* of the wedge assembly except as otherwise noted. Inner plate member 16*c* is thus interchangeable with the other inner plate members 16*a*, 16*b* of the wedge assembly. Inner plate member 16*c* is preferably a one piece member made from metal. A bar or tab member 62 depends from the front 64 of the plate member 16*c*. In alternate embodiments, the tab may be cantilevered from the rear end of the plate member. The tab 62 has a hole 60 formed to therethrough for connecting a terminal lug of a tab or grounding conductor (not shown). Alternatively, the tab may be sized and shaped to fit within a receptacle contact connected to the tab or grounding conductor. When the wedge assembly 14C is being formed, inner plate member 16*c* may replace one of the other interchangeable inner plate member 16*a*, 16*b* shown in FIG. 2 for example. In FIG. 2C, inner plate member 16*c* is shown replacing one of the inner most plate members for example purposes. However, the inner plate member having the connection terminal thereon may be located anywhere in the plate member stack forming the wedge assembly. After assembly, the wedge section 14C is installed into the connector shell 12 in a manner similar to that shown in FIG. 1. The tab or grounding conductor may be terminated to the front terminal connection 58 at any time including prior to assembly of the wedge assembly 14C, or after installation of the wedge assembly 14C into the connector shell section 12.

FIGS. 2A–2D illustrate some of the predetermined configurations in which the wedge assembly in this preferred embodiment of the invention may be formed. The wedge assembly may be provided with still other configurations by interchanging one or more of the interchangeable inner, and outer plate members 16*a*–16*c*, 17–17*b*. FIG. 2E depicts another interchangeable inner plate member 16*e* of the wedge assembly. Inner plate member 16*e* may be interchanged with any of the previously described interchangeable inner plate members 16*a*–16*c* to provide the wedge assemblies 14–14D with the configuration wherein the wedge assembly has teeth or piercing projections 66, 68 disposed in one or both the conductor receiving areas 42, 44 (see FIG. 1) to engage the conductors therein. As can be seen in FIG. 2E, inner plate members 16*e* is substantially similar to other inner plate members of the wedge assembly. In this case, however, the plate member 16*e* is provided with teeth 66, 68 on the top and bottom edges 70, 72. The teeth 66, 68 may be formed when fabricating the inner plate member 16*e* out of the stock plate material. Otherwise, the teeth may be formed subsequent to fabrication of the plate member from stock. The teeth 66, 68 may have a profile terminating in a tip or edge sufficiently sharp to pierce through insulation D on conductors A, B or to bite into and grip bare conductors. In the preferred embodiment, teeth 68 on the bottom edge 72 are smaller than teeth 66 on the top 70. When the inner plate member 16*e* is assembled in a wedge assembly (not shown) the bottom teeth 68 are located in the lower conductor receiving area (similar to conductor receiving area 44 in FIG. 1) and the top teeth 66 are located in the top conductor receiving area (similar to area 42 in FIG. 1). Accordingly, the bottom teeth 68 engage the smaller conductor B, and larger top teeth 66 engage the larger conductor A when the wedge assembly is inserted into the shell section. The smaller size of the bottom teeth 68 prevents damage to the smaller conductor B when the connector is installed on the conductors.

Figure 3:
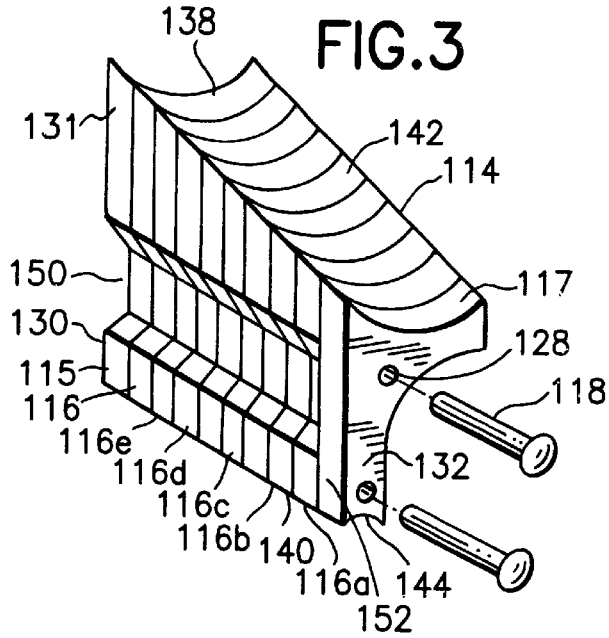
FIG. 3 is an exploded perspective view of a wedge assembly in accordance with a second preferred embodiment of the present invention.

Referring now to FIG. 3, there is shown an exploded perspective view of a wedge assembly 114 in accordance with a second preferred embodiment of the present invention. The wedge assembly 114 of this embodiment, is generally similar to wedge assembly 14 described previously and shown in FIGS. 1, 2. Wedge assembly 114 also has a generally tapered shape from rear 130 to front 132. The tapered wedge assembly 114 is sized and shaped to be inserted into a shell section substantially similar to section 12 in FIG. 1 between two conductors similar to conductors A and B. Accordingly, wedge assembly 114 has inwardly curved top and bottom surfaces 138, 140 forming conductor receiving areas 142, 144. Wedge assembly 114 also has an undercut, or relief groove 150 formed into a side 131. Similar to wedge assembly 14 in FIGS. 1, 2, wedge assembly 114 comprises laminations or plate members 115, 116–116*e*, 117 and fasteners 118. As with wedge assembly 14, the plate members 115, 116–116*e*, 117 may also be interchangeable with other corresponding plate members in order to provide the wedge assembly with a number of predetermined configurations.

As shown in FIG. 3, wedge assembly 114 preferably comprises front and rear outer plate members 117, 115, and a number of inner plate members 116, 116*a*–116*e*. The number of plate members 115, 116–116*e*, 117 used to form wedge assembly 114 may vary depending on the thickness of the plate members. The plate members 115, 116–116*e*, 117 are sized to extend vertically within the wedge assembly 114 from top 138 to bottom 140. The plate members 115, 116–116*e*, 117 are preferably one piece members which may be made from a suitable conductor or insulating material as will be described in greater detail below. The plate members 115, 116–116*e*, 117 are preferably stamped, or cut, from plate stock of suitable thickness. The plate members 115, 116–116*e*, 117 have consecutively increasing lengths from front to rear such that when stacked together the plate members form the tapered shape of wedge assembly 114 (see FIG. 3). The top and bottom ends of each plate member 115, 116–116*e*, 117 are curved to provide top and bottom conductor receiving areas 142, 144 of the wedge assembly 114. Preferably, the inner plate members 116–116*e*, and rear plate member 115, each have a relief notch to provide relief groove 150 when assembled. The front plate member 117 may not be provided with a relief notch. Each plate member 115, 116–116*e*, 117 preferably also has two fastener holes 128 which are vertically aligned with each other. The wedge assembly 114 is formed by stacking the plate members together. The inner plate members 116–116*e* are sandwiched between the front and rear plate 117, 115. As can be seen in FIG. 3, the plate members 115, 116–16*e*, 117 are aligned laterally. Fasteners 118, which may be rivets, screws, or any other type of through fastener similar to fasteners 18 in FIG. 2, are inserted through respective holes 128 to fasten the plate members together and form wedge assembly 114. In alternate embodiments, the plate members of the wedge assembly may be fastened with any suitable number of fasteners, or may be bonded, brazed, or staked together to form the wedge assembly. The wedge assembly 114 may then be inserted into the shell section similar to section 12 in FIG. 1. When the wedge assembly 114 is inserted into the shell section, the front end plate member 117 without the relief notch provides a ledge, or engagement surface 152 which engages the shell section for retaining the wedge assembly 114 in the shell section of the connector.

Figure 3A:
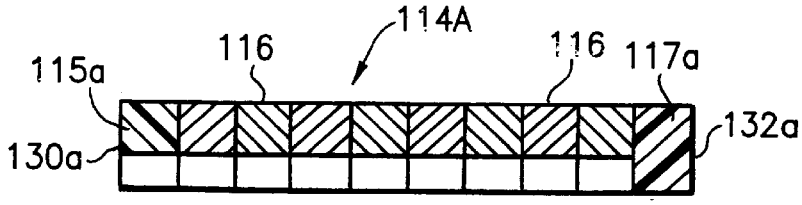
FIG. 3A is a cross-sectional view of the wedge assembly in FIG. 3, showing one of predetermined configurations of the wedge assembly.

Referring now also to FIG. 3A, there is shown a cross section of wedge assembly 114A having a configuration wherein the front and rear end plates 117*a*, 115*a* are made of an insulating material such as glass filled plastic. The wedge assembly 114A in the configuration shown in FIG. 3A is otherwise substantially the same as wedge assembly 114 in FIG. 3. The end plate members 115*a*, 117*a* are otherwise substantially similar to end plate members 115, 117 in FIG. 3. In FIG. 3, all the plate members 115, 116–116*e*, 117 may have been made from conducting materials. The configuration in FIG. 3A, illustrates a feature of the present invention wherein by replacing the interchangeable end plates 115, 117 in FIG. 3, with end plates 115*a*, 117*a* in FIG. 3A, the configuration and characteristics of the wedge assembly may be changed from one predetermined configuration to another predetermined configuration. Similarly, the wedge assembly 114 may be provided with other predetermined configurations by substituting various inner plate members 116, 116*a*–116*e* with inner plate members (not shown) made from different materials. For example, one configuration of the wedge assembly may be formed by using a number of inner plate members made of copper alloy, and the rest made of steel for strength, or from aluminum to reduce weight. In other configurations (not shown), some or all of the inner plate members (not shown) may be made from non-conducting material. In the case of the configuration of the wedge assembly 114A shown in FIG. 3A, when the wedge assembly is inserted into the shell section (similar to C-shaped shell section 12 in FIG. 1), the front and rear plate members 115*a*, 117*a* form front and rear insulating surfaces of the wedge connector. An exterior insulating cover (not shown) may then be installed on the connector to surround the connector in an insulating shell. An exterior cover suitable for encasing the wedge connector is disclosed in U.S. Pat. No. 5,820,422 which is incorporated by reference herein in its entirety.

Figure 3B:
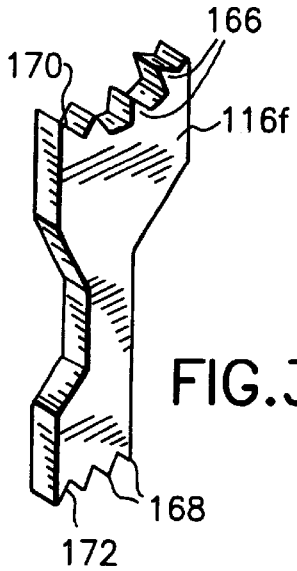
FIG. 3B is a perspective view of an interchangeable plate member for use in the wedge assembly shown in FIG. 3.

FIG. 3B illustrates an interchangeable inner plate member 116*f* which may be used in place of one of the inner plate member 116, 116*a*–116*e* in wedge assembly 114, 114A to provide another predetermined configuration thereof. Inner plate member 116*f* is substantially similar to other inner plate members 116–116*e* of the wedge assembly, but is provided with teeth or piercing projections 166, 168 respectively on the top and bottom ends 170, 172 of the plate. Accordingly, when one or more plate members 116*f* are included in the stack, the wedge assembly is provided with teeth in the top and bottom conducting receiving areas. Such teeth increase the grip of the wedge assembly on the conductors, or may pierce through outer insulation on an insulated conductor to form an electrical connection between the plate member 116*f* and the conductors held by the connector.

The present invention provides a wedge connector 10 with a wedge assembly 14, 114, which can be readily configured to any number of predetermined configurations 14A–14C, 114A by using different combinations of interchangeable plate members when assembling the wedge assembly. Steel or stainless steel plate members may be used to add strength to the wedge assembly. Plate members of copper or copper alloy may be used to add conductivity to the wedge assembly. Plastic plate members may be used to reduce weight of the wedge assembly or to provide insulating features to the wedge assembly. Additional configurations are readily provided to the wedge assembly by including plate members 17*a*, 17*b*, 16*c*, 16*e*, 116*f* which incorporate such features as a terminal connection 46, 58, or portholes 52 for hot sticking, or teeth 66, 68, 166, 168 for gripping conductors or grounding rods in the connector. The plate members are fabricated from inexpensive plate or sheet stock material. The laminated stacked plate construction of the wedge assembly of the present invention provides high column strength to the wedge assembly.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical wedge connector comprising:

a shell; and a wedge section sized and shaped to be inserted into the shell for connecting two conductors to each other, wherein the wedge section comprises a series of consecutively stacked strip elements.

2. An electrical wedge connector in accordance with claim 1, wherein the strip elements of the wedge section extend vertically between conductor receiving areas at opposite top and bottom ends of the wedge section.

3. An electrical wedge connector in accordance with claim 1, wherein at least one of the strip elements of the wedge section has a predetermined characteristic different than another one of the laminations.

4. An electrical wedge connector in accordance with claim 3, wherein the predetermined characteristic is that the at least one strip element has protrusions at least on one end of the strip element, said protrusions being disposed in a conductor receiving area of the wedge section for gripping one of the two conductors connected by the wedge section.

5. An electrical wedge connector in accordance with claim 3, wherein the predetermined characteristic is that the at least one strip element has at least one terminal mounting hole formed therein, or a hole for hot sticking the wedge section or fastening a cable supporting clamp to the wedge section.

6. An electrical wedge connector in accordance with claim 1, wherein at least one of the strip elements is made from conducting material.

7. An electrical wedge connector comprising:

a shell; and a wedge section sized and shaped to be inserted into the shell for connecting two conductors to each other, wherein the wedge section is laminated comprises a series of consecutively stacked strip elements, wherein the strip elements are aligned substantially transverse to a direction in which the wedge section is inserted into the shell.

8. An electrical wedge connector comprising:

a shell; and a wedge section sized and shaped to be inserted into the shell for connecting two conductors to each other, wherein the wedge section is laminated comprises a series of consecutively stacked strip elements, wherein the strip elements are aligned in a direction in which the wedge section is inserted into the shell.

9. An electrical wedge connector in accordance with claim 1, wherein at least one of the strip elements is a metal stamping.

10. An electrical wedge connector in accordance with claim 1, wherein the strip elements are connected by bonding or through fastening.

11. An electrical wedge connector in accordance with claim 1, wherein outer strip elements at opposite ends of the wedge section are made of insulating material, and at least one inner strip element between the outer strip elements is made of a conductive material.

12. An electrical wedge connector in accordance with claim 1, wherein the strip elements are aligned strip elements transverse to a direction in which the wedge section is inserted into the shell.

13. An electrical wedge connector comprising:

a shell; and a wedge section sized and shaped to be inserted into the shell for connecting two conductors to each other, wherein the wedge section is laminated, and wherein at least one of the laminations is made from an insulating material.

14. An electrical wedge connector comprising:

a shell; and a wedge section sized and shaped to be inserted into the shell for connecting two conductors to each other, wherein the wedge section is laminated, and wherein outer laminations at opposite ends of the wedge section are made of insulating material, and at least one inner lamination between the outer laminations is made of a conductive material.

15. An electrical wedge connector comprising:

a shell; and a wedge assembly sized and shaped to be inserted into the shell for connecting two conductors to each other;

wherein the wedge assembly comprises plate members assembled in a stack, at least one of the plate members being an interchangeable plate member selected from a number of different interchangeable plate members to provide the wedge assembly with a predetermined characteristic.

16. An electrical wedge connector in accordance with claim 15, wherein the plate members are assembled in a stack with the sides of the plate members orientated to extend vertically between conductor receiving areas at opposite top and bottom ends of the wedge assembly.

17. An electrical wedge connector in accordance with claim 15, wherein the plate members are assembled in a stack with the sides of the plate members orientated transverse to a longitudinal axis of the wedge assembly.

18. An electrical wedge connector in accordance with claim 15, wherein the plate members are stamped from metal, or dielectric material, and wherein the stack of plate members is bonded or fastened together.

19. An electrical wedge connector in accordance with claim 15, wherein the interchangeable plate member has at least one of, protruding teeth at opposite ends of the plate member for griping the conductors in conductor receiving areas of the wedge assembly, at least one terminal mounting hole, or an aperture for hot sticking the wedge assembly or fastening a cable support clamp to the wedge assembly.

20. An electrical wedge connector comprising:

a shell; and a wedge assembly sized and shaped to be inserted into the shell for connecting two conductors to each other;

wherein the wedge assembly comprises plate members assembled in a stack, at least one of the plate members being an interchangeable plate member selected to provide the wedge assembly with a predetermined characteristic, and wherein the plate members are assembled in a stack with the sides of the plate members orientated to be substantially aligned with a longitudinal axis of the wedge assembly, the plate members assembled in the stack being of sequentially varying height to form conductor receiving areas at opposite top and bottom ends of the wedge assembly.

21. An electrical wedge connector comprising:

a shell; and a wedge assembly sized and shaped to be inserted into the shell for connecting two conductors to each other;

wherein the wedge assembly comprises plate members assembled in a stack, at least one of the plate members being an interchangeable plate member selected to provide the wedge assembly with a predetermined characteristic, and wherein outer plate members at opposite ends of the stack are made of dielectric material, and at least one of the plate members between the outer plate members is made of a conductive material.

22. A method for fabricating an electrical wedge connector, the method comprising the steps of:

providing a shell which is substantially wedge shaped;

stamping plate members;

assembling the plate member side by side into a stack for forming a wedge assembly sized and shaped to be inserted into the shell to connect two conductors to each other; and connecting the plate members in the stack by bonding or fastening.

* * * * *